US012196047B2

(12) United States Patent
Gonzalez Mendilahaxou

(10) Patent No.: US 12,196,047 B2
(45) Date of Patent: Jan. 14, 2025

(54) AUTOMATIC TRICONE EXCHANGE, STORAGE AND LUBRICATION SYSTEM

(71) Applicant: DV TECHNOLOGY SPA, Santiago (CL)

(72) Inventor: Jose Damian Gonzalez Mendilahaxou, Santiago (CL)

(73) Assignee: DV TECHNOLOGY SPA, Santiago (CL)

( * ) Notice: Subject to any disclaimer, the term of this patent is extended or adjusted under 35 U.S.C. 154(b) by 0 days.

(21) Appl. No.: 18/574,577

(22) PCT Filed: Jul. 30, 2021

(86) PCT No.: PCT/IB2021/056992
§ 371 (c)(1),
(2) Date: Jan. 4, 2024

(87) PCT Pub. No.: WO2023/007231
PCT Pub. Date: Feb. 2, 2023

(65) Prior Publication Data

US 2024/0344409 A1 Oct. 17, 2024

(51) Int. Cl.
*E21B 19/18* (2006.01)
*E21B 4/00* (2006.01)
(Continued)

(52) U.S. Cl.
CPC ..... *E21B 19/18* (2013.01); *E21B 4/003* (2013.01); *E21B 19/14* (2013.01); *E21B 19/20* (2013.01)

(58) Field of Classification Search
CPC ..... E21B 19/18; E21B 19/14; E21B 19/20; E21B 4/003
See application file for complete search history.

(56) References Cited

U.S. PATENT DOCUMENTS 6,311,789 B1 * 11/2001 Saxman ..... E21B 19/18 175/57
6,505,531 B2 1/2003 Stogner
(Continued)

FOREIGN PATENT DOCUMENTS

AU 2017200871 A1 8/2017
CN 209663622 U 11/2019
(Continued)

OTHER PUBLICATIONS

International Search Report for Corresponding International Application No. PCT/IB2021/056992 dated Mar. 28, 2022.

*Primary Examiner* — Aaron L Lembo
(74) *Attorney, Agent, or Firm* — LUCAS & MERCANTI, LLP

(57) ABSTRACT

An automated system (100) and method for removing and installing drill bits or tricone bits that is safe, with low energy consumption and adaptable to existing drilling systems (1) and break-out wrenches (2), comprising: a base structure (101) that is attached to the drilling system (1); a mobile table (102) that moves on a base structure (101) for replacing tricone bits (103); a handling system (104) located on the base structure (101) for moving the tricone bits (103) from the mobile table (102) to the drilling system (1); control (200) that define the movement and synchronise the mobile table (102), the handling system (104) and the break-out wrench (2); and sensors, that supply data to the control means (200) on the location of the mobile table (102), the handling system (104), the hoisting claw (105) and the break-out wrench (2).

17 Claims, 5 Drawing Sheets

(51) Int. Cl.
*E21B 19/14* (2006.01)
*E21B 19/20* (2006.01)

(56) References Cited

U.S. PATENT DOCUMENTS

| | | | | |
|---|---|---|---|---|
| 9,097,070 | B2 * | 8/2015 | Hunter | G05B 15/02 |
| 10,435,964 | B2 * | 10/2019 | Magnuson | E21B 19/14 |
| 10,597,956 | B2 * | 3/2020 | Gaska | E21B 15/00 |
| 11,506,002 | B2 * | 11/2022 | Simanjuntak | E21B 19/06 |
| 2008/0271922 | A1 * | 11/2008 | Haughom | E21B 15/02 175/10 |
| 2010/0108388 | A1 * | 5/2010 | Pires | E21B 19/146 175/52 |
| 2017/0234086 | A1 | 8/2017 | Gaska | |
| 2021/0198960 | A1 | 7/2021 | Branson et al. | |

FOREIGN PATENT DOCUMENTS

| | | | | |
|---|---|---|---|---|
| EP | 0860580 | A1 | 8/1998 | |
| EP | 2487325 | A2 * | 8/2012 | E21B 19/167 |
| WO | WO-2005073497 | A1 * | 8/2005 | E21B 19/155 |
| WO | 2019226096 | A1 | 11/2019 | |
| WO | WO-2022200831 | A1 * | 9/2022 | |
| WO | WO-2024013549 | A1 * | 1/2024 | |

* cited by examiner

AUTOMATIC TRICONE EXCHANGE, STORAGE AND LUBRICATION SYSTEM

CROSS-REFERENCE TO RELATED APPLICATIONS

This application is a 371 of PCT/IB2021/056992, filed Jul. 30, 2021, which is incorporated herein by reference.

FIELD OF INVENTION

The present invention relates to the mining industry, drilling, prospecting and extraction of minerals and/or hydrocarbons among other industries using surface drilling elements. In particular, the present invention relates to a system and method of extracting and installing tricones in an automated manner, with low energy consumption and adaptable to existing platforms. This system and method uses the hydraulic power of the drill already installed and due to its technical configuration avoids accidents to the technical personnel, since the replacement of the tricones is done in an automated way, thus improving the safety of personnel and equipment, thus achieving a better operational continuity in the operation of tricone change.

PRIOR ART

Currently in the mining, drilling, prospecting and hydrocarbon extraction industry, there is considerable risk exposure for people involved in the drilling process, specifically during the change of tricones. This is due to the weight of the tricones, the limited space for action due to the compact design of the drilling rig platforms, among other factors. Likewise, these factors cause the tricone change process to take longer, decreasing drilling availability, which directly affects the mine's productivity due to the cumulative time of tricone change, and generates an impossibility of completely autonomous fleets as a result of one or more factors that are not automated depending on the drilling rig. Tricone replacement is a key link in the operational chain that hinders fleet autonomy because it is not automated. In addition to this, the non-automated tricone change implies requiring rotating shifts of qualified personnel for the extraction and replacement of tricones in the drilling systems, which makes the operation more complex and, as mentioned above, increases the risk to people and equipment. In the prior art, several solutions have been found, which partially solve the technical problem posed, emphasizing that the proposed solution, being versatile, can be integrated to drilling machines that currently do not have this automated process, allowing that these can be repowered to increase the autonomy of these. Within the known is patent N AU 2017200871A1, which discloses in drill bit change assembly, a drill bit basket actuator assembly configured to be coupled to a carriage-mounted drilling rig; the drill bit basket actuator assembly includes an actuator, a rail guide, and a drill bit basket that is movably coupled to the rail guide through actuation of the actuator; the bit change assembly also includes a bit carousel configured to be coupled to the carriage-mounted drilling rig such that the bit carousel moves rotationally and vertically with respect to the carriage-mounted drilling rig, but this document discloses complex bit change assembly, which requires multiple drill bit or tricone rotation and translation subsystems, with their respective sensors and rotation control actuators, unlike the system presented in this document which is easy to maintain and adapt to existing structures.

Another document within the prior art is patent U.S. Pat. No. 6,505,531B2, which discloses an oil tool connection uncoupler and method, comprising a bit-breaking cross plate, which is attached to the bottom surface of an electric wrench to effect the coupling or uncoupling of downhole tools such as bits or stabilizers. The plate is hinged and provides a generally triangular profile along its transverse surface that engages with the bit or stabilizer, which is connected or disconnected. The hinged plate is removably attached under the electric key with pins. This document does not disclose an automated system and method of disassembly and assembly of drill bits or tricones, which allows to exchange the worn tricone completely autonomously for a new tricone, additionally it does not contain a joint lubricator to decrease the likelihood of mechanical locking with the drilling rod. Specifically, the reactive component of the tricone release system has a manual coupling and uncoupling that involves the presence of people directly in the drilling area, unlike the system presented in this document, which for its intervention and maintenance is located in the areas surrounding the drilling area, which implies additional safety for people.

Another prior art document is patent application US20170234086A1, which discloses a mechanism for retaining drill bits in a drill, comprising a drill bit retaining assembly including a ring, a drill bit retaining member coupled to the ring, and an actuator coupled to the ring. The bit clamp member can be moved through the actuator between a first position, in which the bit clamp member is configured to engage with a bit and a second position in which the bit clamp member is configured to disengage from the bit. This document does not disclose a joint lubrication mechanism for ensuring a lubricated joint with the drilling rod. This system occupies a considerable amount of space in the drilling work zone and therefore compromises its design to the amount of space available in that zone. In a variety of drilling rigs the available space in the drilling area is limited, so the design presented in this document presents greater versatility of adaptation to drilling rigs taking into account the compact design of the drilling platforms, being at the same time the solution presented in this document, compatible with multiple models of multiple brands of drilling rigs.

Therefore, it is observed that the prior art does not solve the global technical problem of automated tricone exchange, which requires more than just tightening and loosening the tricone for its exchange, it also requires a cleaning and lubrication system that facilitates the operation, an automated tricone storage system, easy adaptation and installation to different types of drilling rigs, including the automated tricone exchange processes in a single equipment to facilitate the maintenance and repowering of existing drilling rigs, most of which are compact. This system, which meets the aforementioned requirements, removes operators from the risky process of exchanging tricones, providing greater protection to the operator, which also increases productivity and advances in the process of complete autonomy of existing drilling rig fleets.

SOLUTION TO THE TECHNICAL PROBLEM

In order to solve this problem, an automated system and method for tricone exchange is presented, which is safe, energy efficient and adaptable to existing drilling systems, allowing tricone storage on the drilling rig platform, with easy access to remove worn tricones and replace them with new ones once they have been used. It also solves the problem of manual lubrication of the tricones before installation, thus increasing people's safety. Likewise, it allows to develop the activities of handling accessories and tricones simultaneously which accelerates the speed of tricone exchange, using Cartesian movements to consider the shortest possible distance between the storage space of the accessory and/or tricone and the drilling zone. On the other hand, the mobile storage table provides an ergonomic multipurpose place to locate tricones and other process accessories for handling without human intervention, which reduces process execution times and increases personal safety. At the same time, the system and method presented can be adapted to a variety of drilling rigs since it is located in areas close to the drilling area of the platform, which allows taking advantage of such space, unlike other solutions that are located above the drilling area producing space limitations in their equipment and/or limiting the operation of the drilling rig, which makes the operation more complex.

SUMMARY DESCRIPTION OF THE INVENTION

This automated tricone exchange system and method allows automating the process of exchanging the worn tricone for a new tricone, without human intervention in the process, increasing the availability of the drilling rig, which implies a higher productivity of the drilling rig, and also this system and method can be attached to the existing drilling rigs.

Furthermore, it ensures that several new tricones will be available so that the process can be performed iteratively, with automated lubrication and easy adaptation and installation for different drilling rigs.

The presented equipment is composed in one of its configurations of tricone mobility, loading and unloading device; tricone storage device and tricone lubrication device.

DESCRIPTION OF THE INVENTION

Figure 1:
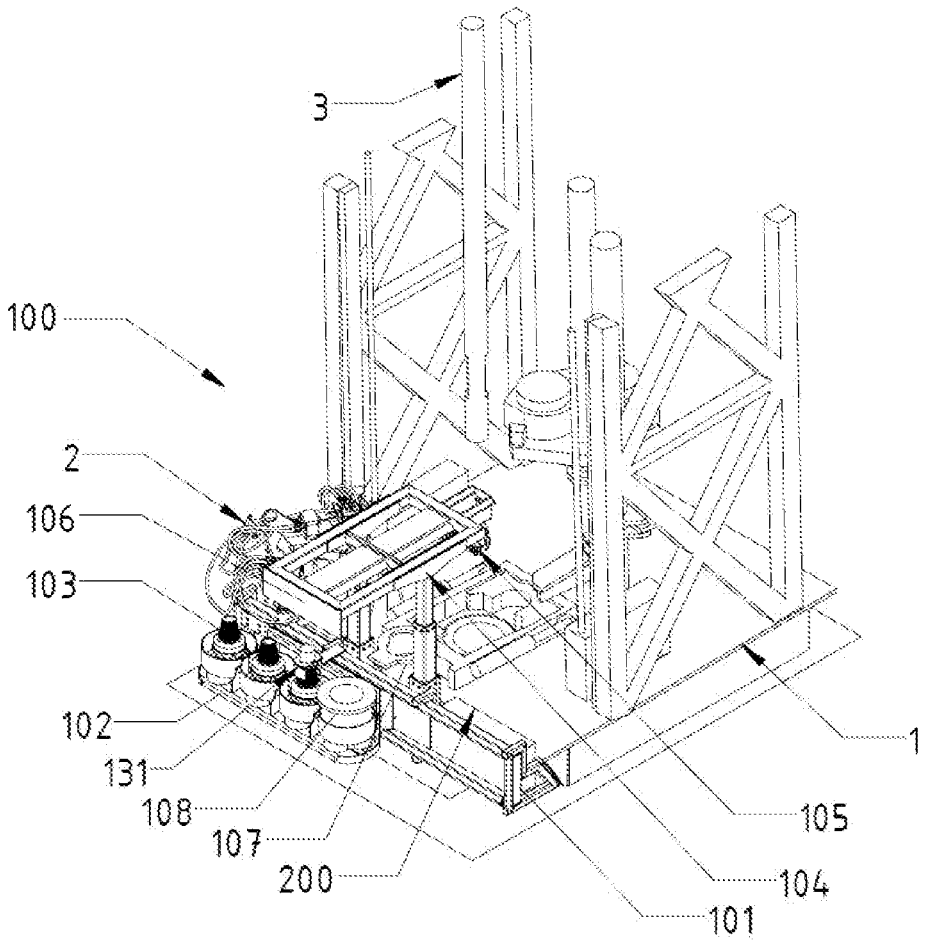
FIG. 1 shows isometric view of tricone exchange system.
Figure 2:
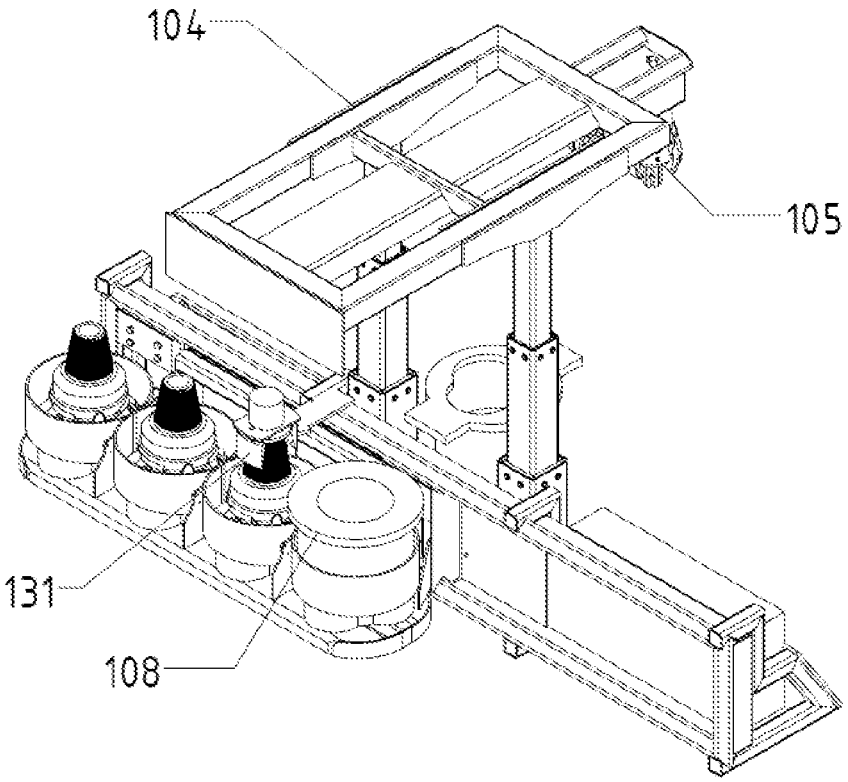
FIG. 2 shows isometric view of the tricone exchange system at the centering ring pick-up stage of the mobility table by manipulation tower.
Figure 3:
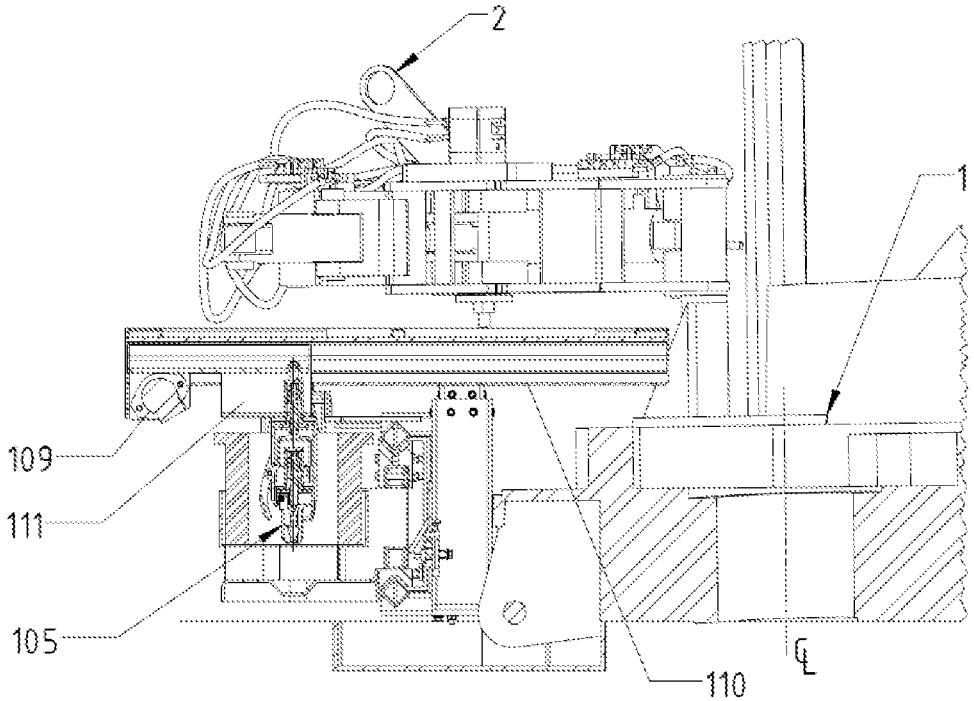
FIG. 3 shows a cross section of the manipulation tower showing the mechanism of horizontal linear mobility of the tricone manipulation grippers, centering ring and tricone cutting pot.
Figure 4:
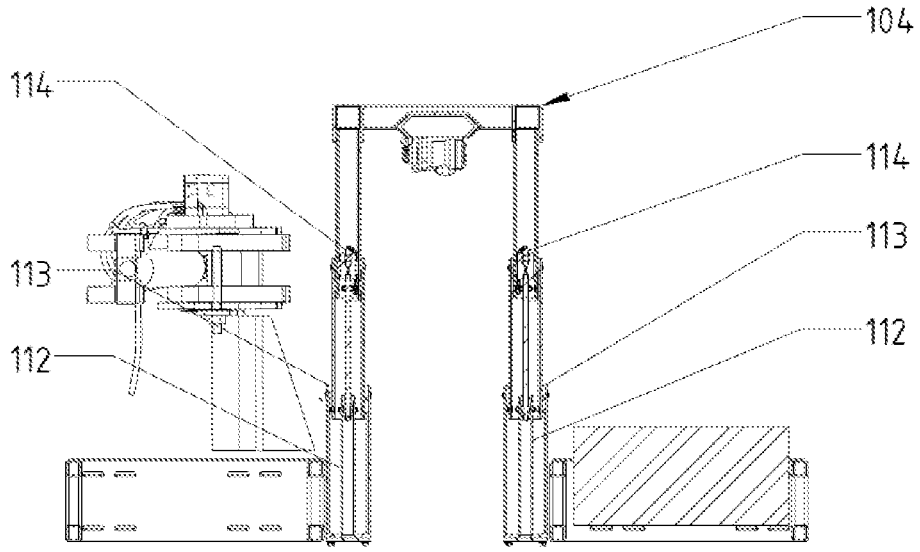
FIG. 4 shows a cross-section of the handling tower showing the mechanism of vertical linear mobility of the upper part of the handling tower.
Figure 5:
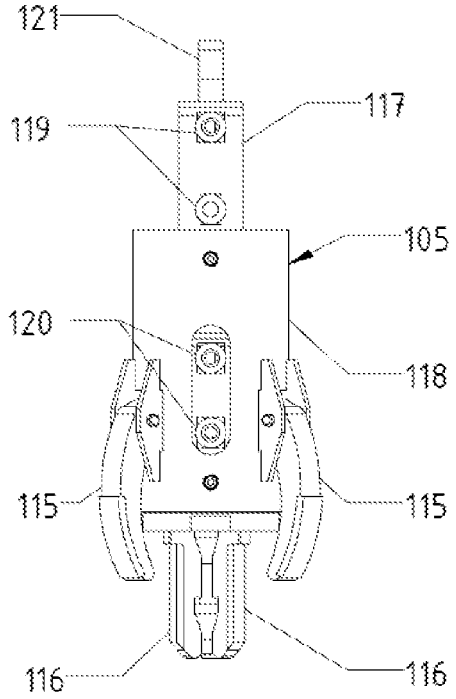
FIG. 5 shows tricone manipulation grippers.
Figure 6:
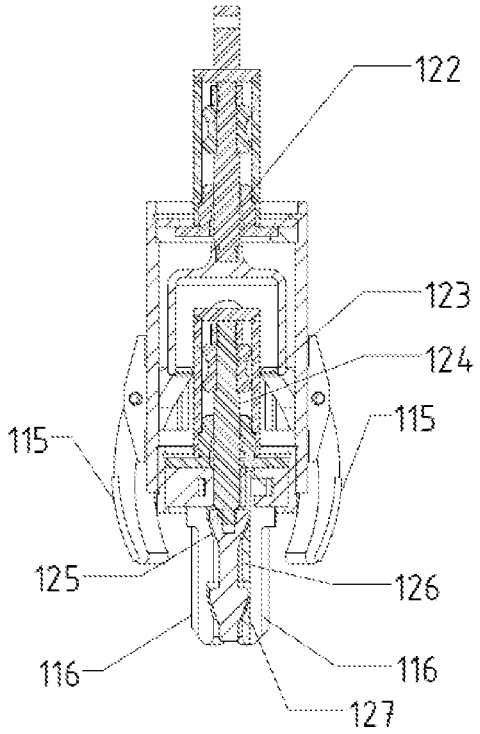
FIG. 6 shows a cross-section of the grippers.
Figure 7:
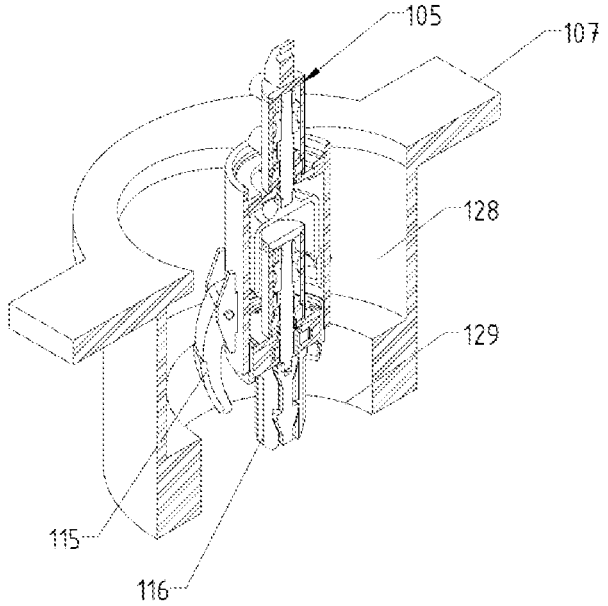
FIG. 7 shows isometric view with cross section of gripper illustrating process of grasping centralizing ring by gripper by using the longer length hinged grippers of the gripper device.
Figure 8:
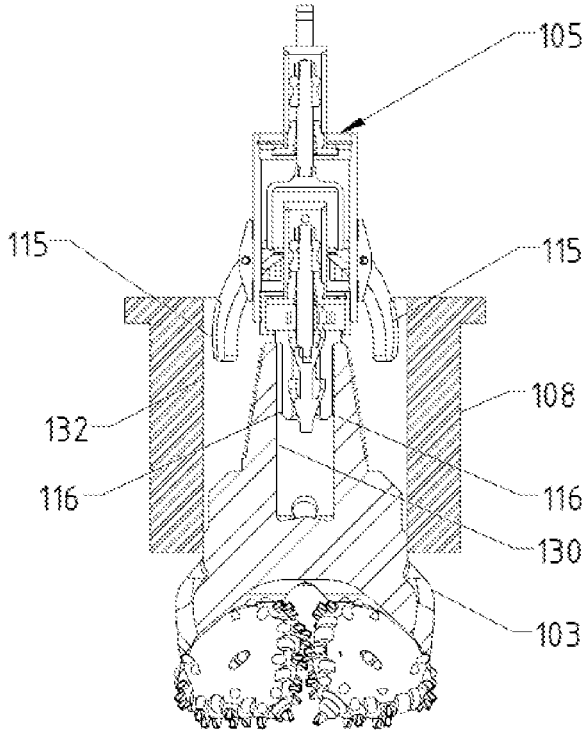
FIG. 8 shows cross section of grippers, centering ring and tricone, illustrating the gripping mechanisms of centering ring and tricone by grippers.

The present invention is related to the mining industry, drilling, geological prospecting and hydrocarbon extraction among other industries that use surface drilling elements, decreases to one third the time of tricone change, achieving an increase in the availability of drilling machines, which implies an increase in productivity. In particular, the present technology relates to an: automated system (100) for disassembly and assembly of drill bits or tricones, safe, energy efficient and adaptable to existing drilling (1) and breaker wrench (2) systems, comprising:

- a base structure (101) that is attached to the drilling system (1);
- a mobile table (102) that moves on a base structure (101), for the replacement of tricones (103);
- a handling system (104) which is positioned on the base structure (101) to move the tricones (103) from the mobile table (102) to the drilling system (1); wherein the handling system (104) comprises:
- a lifting structure (106) comprising a lifting clamp (105), for lifting the tricones (103) or a tricone cutting pot (107) or a centering ring (108);
- means for moving the lifting clamp (105); and
- a lifting means (112) of the lifting structure (106);
- the tricone cutting pot (107) which is placed on the mobile table (102) during the drilling operation and which is used to receive the reaction of the breaker wrench (2) to make the tricone static when the turn is applied with the breaker wrench (2);
- the breaker wrench (2) is placed on the drilling system (1) to turn the drilling rods;
- the centering ring (108) to center the tricone when the turn is applied with the breaker wrench (2);
- lubricating means (131) for lubricating the thread of the tricones (103);
- control means (200) defining the movement and synchronizing the mobile table (102), the handling system (104) and the breaker wrench (2); and
- sensors, not shown in the figures, which feed data to the control means (200), of the location of the moving table (102), the handling system (104), lifting clamp (105) and the breaking key (2).

The base structure (101) which is attached to the drilling system (1) by means of fastening means, not shown in the figures, which are chosen from bolts, screws, rivets, quick couplings.

In a preferred configuration the lifting means (112) are pistons which are connected to the handling system (104) by means of linear motion amplification means (114) to vary the upward or downward speed of the lifting structure (106), and the lifting means (112) further comprise protective elements (113), which protect said lifting means (112) from shock and/or dirt.

In another preferred configuration, the lifting means (112) are electric or hydraulic or pneumatic motors, which are connected to the handling system (104) by means of connecting means.

The lifting clamp (105) comprises: a connecting rod (121) connecting the lifting clamp (105) to the handling system (104);

- an upper actuator (117) linking the connecting rod (121) with a clamp fixing chassis (118) and actuated through a guide element (122);
- upper jaws (115) and lower jaws (116) are operatively coupled to the clamp fixing chassis (118), wherein the upper jaws (115) move to retain the centering ring (108) or tricone cutting pot (107) and the lower jaws (116) move to grasp the tricone (103) by contacting an inner surface of the tricone (130), wherein the upper actuator (117) actuates the upper jaws (115) through a pivot joints (123) by energizing an upper linear actuator power connection (119) and a lower actuator (124) actuates the lower jaws (116) by energizing a lower linear actuator power connection (120), wherein an upper tapered spacer (125) and a lower tapered spacer (127) act upon an act upon a radial guide (126).

The tricone cutting pot (107) comprises: an inner surface tricone cutting pot (128) on which the upper jaws (115) rest; and an inner reinforcement tricone cutting pot (129).

In another preferred configuration, the lubrication means (131) comprise lubricating arms comprising rotating means for rotating concentrically around the tricone thread (103) to clean and lubricate the tricone thread (103) through lubricant outlet nozzles to prevent the tricone thread (103) from locking to the drilling rod (3).

In another preferred configuration, an actuator (109) moves the lifting clamp (105) horizontally.

In another preferred configuration, a rotary actuator (111) moves the lifting clamp (105) horizontally along a rack (110).

The present invention further comprises an automated method of disassembly and assembly of drill bits or tricones, safe, energy efficient and adaptable to existing drilling systems (1), through system (100) comprising the following steps:

I. providing a base structure (101) that is attached to the drilling system (1);

II. installing a tricone (103) on a drilling rig of the drilling system through the following steps:

a. retaining and moving a tricone cutting pot (107) from a mobile table (102) that moves on a base structure (101), for the replacement of tricones (103) to the drilling area, by means of a handling system (104) and a lifting clamp (105);

b. gripping a centering ring (108) with the lifting clamp (105), to center the tricone and in turn clean and lubricate the thread of a following tricone (103) by means of thread lubrication means (131);

c. raising the centering ring (108) with the lifting clamp (105) which is attached to the lifting structure (106) which is raised or lowered by means of lifting means (112); and while it is lifted, move the mobile table (102) to the next tricone (103);

d. lowering the centering ring (108) and take the cleaned and lubricated tricone (103) with the lifting clamp (105);

e. moving the centering ring (108) and the cleaned and lubricated tricone (103) from the mobile table (102) to the tricone cutting pot (107) located in the drilling zone, by means of displacement means;

f. releasing the centering ring (108) and the cleaned and lubricated tricone (103) and return the lifting clamp (105) to the mobile table (102) which moves on a base structure (101), for the replacement of some tricones (103) to the tricone positioning area (103), by means of a handling system (104);

h. lowering the drilling rod and attach the drilling rod to the tricone (103);

i. retaining and removing the tricone cutting pot (107) from the drilling area to the mobile table (102), by means of a handling system (104) and the lifting clamp (105);

III. drilling the hole with the tricone (103) and when the useful life of the tricone (103) is over, the tricone (103) is lifted by means of the drilling rod with the centering ring (108);

IV. replacing the tricone (103) through the following steps:

j. retaining and moving the tricone cutting pot (107) from a mobile table (102) that moves on the base structure (101), for the replacement of the worn tricone (103) to the drilling zone, by means of a handling system (104) and a lifting clamp (105);

k. grabbing the worn tricone (103) and insert it into the tricone cutting pot (107);

l. releasing the worn tricone (103) with a breaker wrench (2), return the breaker wrench (2) to the rest position and raise the drilling rod;

m. retaining and moving the worn tricone (103) and insert it into the tricone cutting pot (107) from the drilling area to the mobile table (102) by means of a handling system (104) and the lifting clamp (105), while cleaning and greasing the thread of the next tricone (103) by means of the thread lubrication means (131);

n. repeat steps c. to h. for the installation of the next tricone (103) to continue drilling.

The following is a detailed description of how some of the jaws work:

This method comprises in stages b. and f. moving upper jaws (115) to retain on the centering ring (108) when resting on an inner surface.

This method comprises in stages a., h., i. and l. moving upper jaws (115) to retain the tricone cutting pot (107) when resting on an inner surface tricone cutting pot (128).

This method comprises in stages d., f., j. and h. of gripping or releasing the tricone (103) is through lower jaws (116) upon contacting an inner surface of the tricone (130).

Horizontally moving the lifting clamp (105) is by means of an actuator (109) and horizontally moving the lifting clamp (105) along a rack (110) by means of a rotary actuator (111).

Example of Application

Grab, with the lifting clamp the tricone cutting pot and move the tricone cutting pot from the mobile table to the drilling structure by means of the handling system; grab with the lifting clamp the centering ring while greasing the tricone thread; lift the centering ring and move the tricone in a previously fixed position on a set displacement unit; grab the tricone, lift it and move it with the centering ring with the tricone inside it from the mobile table to the drilling structure by means of the handling system; fix the tricone to the drilling rod by means of a thread through the turning of the drilling rod; and remove the tricone cutting pot from the base structure to the drilling system to the mobile table by means of the handling system. After the drilling process and for the replacement of the worn tricone leave the worn tricone lifted up; grip, with the lifting clamp the tricone cutting pot and move the tricone cutting pot from the mobile table to the drilling rig by means of the handling system; insert the worn tricone inside the tricone cutting pot while the new tricone is automatically greased; with the cutter wrench loosen the worn tricone from the drilling rod and lift the drilling rod; take the worn tricone, lift it and move it with the centering ring with the worn tricone inside it from the drilling frame to the mobile table by means of the handling system; leave the tricone on the mobile table while greasing the new tricone; take the new tricone, lift it up and move it with the centering ring with the new tricone inside it from the mobile table to the drilling rig by means of the handling system; fix the new tricone to the drilling rod by means of a thread through the turning of the drilling rod; and remove the tricone cutting pot from the base structure to the drilling system to the mobile table by means of the manipulation system, achieving the tricone change in 10 minutes.

With the time savings of at least 20 minutes per tricone, an increase in availability of at least 1.5 hours per week, per drilling rig, is achieved, which implies the increase of at least two additional drilling wells per week.

To facilitate the reader's understanding, a list of parts of this system is presented:

(1) drilling systems (1);
(2) breaker wrench (2);
(3) drilling rod (3);
(100) system (100);
(101) base structure (101);
(102) mobile table (102);
(103) triconos (103);
(104) handling system (104);
(105) lifting clamp (105);
(106) lifting structure (106);
(107) tricone cutting pot (107);
(108) centering ring (108);
(109) Actuator (109);
(110) Rack (110);
(111) rotary actuator (111);
(112) lifting means (112);
(113) protection elements (113);
(114) linear motion amplification means (114);
(115) upper jaws (115);
(116) lower jaws (116);
(117) upper actuator (117);
(118) clamp fixing chassis (118)
(119) Upper Linear Actuator Power Connection (119)
(120) Bottom Linear Actuator Power Connection (120)
(121) connecting rod (121);
(122) a guide element (122);
(123) pivot joint (123);
(124) lower actuator (124);
(125) upper tapered spacer (125);
(126) a radial guide (126);
(127) lower tapered spacer (127);
(128) inner surface of tricone cutting pot (128);
(129) internal reinforcement of the tricone cutting pot (129);
(130) inner surface of the tricone (130);
(131) lubrication means (131);
(132) inner surface of the centering ring (132), and
(200) control means (200).

The invention claimed is:

1. An automated system (100) for disassembly and assembly of drill bits or tricones, safe, energy efficient and adaptable to existing drilling (1) and breaker wrench (2) systems, comprising:

a base structure (101) that is attached to the drilling system (1);

a mobile table (102) that moves on the base structure (101), for the replacement of tricones (103);

a handling system (104) which is positioned on the base structure (101) to move the tricones (103) from the mobile table (102) to the drilling system (1); wherein the handling system (104) comprises:

a lifting structure (106) comprising a lifting clamp (105), for the lifting of the tricones (103); of a tricone cutting pot (107); or of a centering ring (108);

means for moving the lifting clamp (105); and a lifting means (112) of the lifting structure (106);

the tricone cutting pot (107) which is placed on the mobile table (102) during the drilling operation and which is used to receive the reaction of the breaker wrench (2) to make the tricone static when the turn is applied with the breaker wrench (2);

the breaker wrench (2) is placed on the drilling system (1) to turn the drilling rods;

the centering ring (108) to center the tricone when the turn is applied with the breaker wrench (2);

lubricating means (131) for lubricating the thread of the tricones (103);

control means (200) defining the movement and synchronizing the mobile table (102), the handling system (104) and the breaker wrench key (2); and sensors, which feed data to the control means (200), about the location of the mobile table (102), the handling system (104), the lifting clamp (105) and the breaking key (2).

2. The automated system (100) according to claim 1, wherein the base structure (101) is attached to the drilling system (1) by means of fastening means selected from the group consisting of bolts, screws, rivets, and quick couplings.

3. The automated system (100) according to claim 1, wherein the lifting means (112) are pistons which are connected to the handling system (104) by linear motion amplification means (114) to vary the upward or downward speed of the lifting structure (106).

4. The automated system (100) according to claim 1, wherein the lifting means (112) further comprise protective elements (113), which protect said lifting means (112) from shock and/or dirt.

5. The automated system (100) according to claim 1, wherein the lifting means (112) are electric or hydraulic or pneumatic motors, which are connected to the handling system (104) by means of connecting means.

6. The automated system (100) according to claim 1, wherein the lifting clamp (105) comprises:

a connecting rod (121) connecting the lifting clamp (105) to the handling system (104);

an upper actuator (117) linking the connecting rod (121) with a clamp fixing chassis (118) and actuated through a guide element (122);

upper jaws (115) and lower jaws (116) which are operatively joined with the clamp attachment chassis (118), wherein the upper jaws (115) are displaced to retain the centering ring (108) or tricone cutting pot (107) and the lower jaws (116) are displaced to grasp the tricone (103) upon contact with an inner surface of the tricone (130).

7. The automated system (100) according to claim 6, wherein the upper actuator (117) actuates the upper jaws (115) by means of pivot joints (123) by energizing an upper linear actuator power connection (119) and a lower actuator (124) actuates the lower jaws (116) by energizing a lower linear actuator power connection (120), wherein an upper tapered spacer (125) and a lower tapered spacer (127) act on a radial guide (126).

8. The automated system (100) according to claim 6, wherein the tricone cutting pot (107) comprises:

an inner surface of tricone cutting pot (128) on which the upper jaws (115) are supported; and an inner reinforcement of a tricone cutting pot (129).

9. The automated system (100) according to claim 1, wherein the lubricating means (131) comprise lubricating arms comprising rotating means for rotating concentrically around the tricone thread (103) and thereby cleaning and lubricating said tricone thread (103) through lubricant outlet nozzles to prevent the tricone (103) from locking to the drilling rod (3).

10. The automated system (100) according to claim 1, wherein an actuator (109) horizontally displaces the lifting clamp (105).

11. The automated system (100) according to claim 1, wherein a rotary actuator (111) horizontally moves the lifting clamp (105) along a rack (110).

12. An automated method of disassembling and assembling drill bits or tricones, safe, energy efficient and adaptable to an existing drilling system (1), by means of a system (100), the method comprises:

I. providing a base structure (101) that is attached to the drilling system (1);

II. installing a tricone (103) on a drilling rod of the drilling system through the following steps:

a. retaining and moving a tricone cutting pot (107) from a mobile table (102) that moves on the base structure (101), for the replacement of tricones (103) to the drilling area, by means of a handling system (104) and a lifting clamp (105);

b. grabbing a centering ring (108) with the lifting clamp (105), to center the tricone and in turn clean and lubricate the thread of a following tricone (103) by means of thread lubrication means (131);

c. raising the centering ring (108) with the lifting clamp (105) which is attached to a lifting structure (106) which is raised or lowered by means of lifting means (112); and while being lifted move the moving table (102) to the next tricone (103);

d. lowering the centering ring (108) and take the cleaned and lubricated tricone (103) with the lifting clamp (105);

e. moving the centering ring (108) and the cleaned and lubricated tricone (103) from the mobile table (102) to the tricone cutting pot (107) located in the drilling zone, by means of displacement means;

f. releasing the centering ring (108) and the cleaned and lubricated tricone (103) and return the lifting clamp (105) to the mobile table (102) which moves on the base structure (101), for the replacement of some tricones (103) to the tricone positioning area (103), by means of a handling system (104);

g. lowering the drilling rod and fix the drilling rod to the tricone (103);

h. retaining and removing tricone cutting pot (107) from the drilling area to the mobile table (102), by means of a handling system (104) and the lifting clamp (105);

III. drilling the hole with the tricone (103) and when the useful life of the tricone (103) is over, the tricone (103) is lifted by means of the drilling rod with the centering ring (108);

IV. replacing the tricone (103) through the following steps:

i. retaining and moving the tricone cutting pot (107) from a mobile table (102) that moves on the base structure (101), for the replacement of the worn tricone (103) to the drilling zone, by means of a handling system (104) and a lifting clamp (105);

j. grabbing the worn tricone (103) and insert it into the tricone cutting pot (107);

k. releasing the worn tricone (103) with a breaker wrench (2), return the breaker wrench (2) to the rest position and raise the drilling rod;

l. retaining and moving the worn tricone (103) and insert it into the tricone cutting pot (107) from the drilling area to the mobile table (102) by means of a handling system (104) and the lifting clamp (105), while cleaning and greasing the thread of the next tricone (103) by means of the thread lubrication means (131);

m. repeating steps c. to h. for the installation of the next tricone (103) to continue drilling.

13. The automated method according to claim 12, wherein in stages b. and f. moving upper jaws (115) to retain on the centering ring (108) when resting on an inner surface.

14. The automated method according to claim 12, wherein in stages a., h., i. and l. moving upper jaws (115) to retain the tricone cutting pot (107) when resting on an inner surface of a tricone cutting pot (128).

15. The automated method according to claim 12, wherein in stages d., f., j. and h., gripping or releasing the tricone (103) through lower jaws (116) upon contacting an inner surface of the tricone (130).

16. The automated method according to claim 12, wherein moving the lifting clamp (105) horizontally is by means of an actuator (109).

17. The automated method according to claim 12, further comprising horizontally moving the lifting clamp (105) along a rack (110) is by means of a rotary actuator (111).

* * * * *